US005785595A

United States Patent [19]

Gauselmann

[11] Patent Number: 5,785,595

[45] Date of Patent: Jul. 28, 1998

[54] METHOD FOR THE DETERMINATION OF STOP POSITIONS OF ROTATING REEL BODIES OF A GAME DISPLAY DEVICE OF A GAMBLING MACHINE

[75] Inventor: Michael Gauselmann, Espelkamp, Germany

[73] Assignee: Atronic CASINO Technology Distribution GmbH, Espelkamp, Germany

[21] Appl. No.: 531,497

[22] Filed: Sep. 21, 1995

[30] Foreign Application Priority Data

Sep. 23, 1994 [DE] Germany ..... 44 34 129.6

[51] Int. Cl.[6] ..... G07F 17/34

[52] U.S. Cl. ..... 463/20; 463/22; 273/143 R; 273/138.2

[58] Field of Search ..... 273/143 R, 138.2; 463/20, 22

[56] References Cited

U.S. PATENT DOCUMENTS

| | | | |
|---|---|---|---|
| 4,772,023 | 9/1988 | Okada | 273/143 R |
| 5,083,785 | 1/1992 | Okada | 273/143 R |
| 5,085,436 | 2/1992 | Bennett | 273/143 R |
| 5,423,541 | 6/1995 | Nicastro et al. | 273/143 R |
| 5,511,784 | 4/1996 | Furry et al. | 273/143 R |

*Primary Examiner*—Benjamin H. Layno
*Attorney, Agent, or Firm*—Horst M. Kasper

[57] ABSTRACT

A random number generator determines the stop positions of display means of entertainment machines and of gambling machines. The random number generator is a component of the control unit which assumes the sequential play control. A uniform stopping of the rotating reel body is made possible and the stop positions cannot be reconstructed and predicted. In order to stop the rotating reel body in a non-reconstructable but uniform way in specific symbol-combination-displaying rest positions, a disjoint subset of the set of numbers accessible by the pseudo-random number generator is coordinated to each win class. Subsequently, a pseudo-random number is generated by the pseudo-random number generator and a win class is associated to this pseudo-random number. The symbol combination of the thus determined win class to be displayed is subsequently displayed with the rotating reel bodies stopped in position displaying symbols associated with the win class.

16 Claims, 5 Drawing Sheets

| WIN CLASS | NUMBER REGION | SYMBOL COMBINATION |
|---|---|---|
| 0 | 1 ... 84279 | A B C |
| 1 | 84280 ... 92554 | D E F G |
| 2 | 92555 ... 97834 | H |
| 3 | 97835 ... 99074 | I |
| 4 | 99075 ... 99494 | J K |
| . | . | . |
| . | . | . |
| . | . | . |
| . | . | . |
| 9 | 99996 ... 100000 | X Y |

Fig.5

METHOD FOR THE DETERMINATION OF STOP POSITIONS OF ROTATING REEL BODIES OF A GAME DISPLAY DEVICE OF A GAMBLING MACHINE

BACKGROUND OF THE INVENTION

1. Field of the Invention

The invention relates to a method for the determination of stop positions of rotating reel bodies of a game display device of a gambling machine.

2. Brief Description of the Background of the Invention Including Prior Art

An electronic gambling machine of the kind of a roulette is known from the German printed patent document DE 21 46 096 B1, which gambling machine exhibits a pot or group of numbers, wherein a winning number is selected from a predetermined plurality of numbers according to a system which cannot be influenced by the player. The known electronic gambling machine includes an oscillator which circulates through the pot of numbers with a high rotational frequency and determines a number of the pot of numbers for each point in time, wherein the rotational frequency can be changed by a frequency control system. This circulation is stopped by the player. Based on the high rotational frequency, a random number is to be selected by stopping the circulation, wherein the oscillator frequency is lowered within a predetermined time period to the value 0. The selection of the winning number is at random in view of the high circulation speed and the player action and can therefore not be influenced. The known electronic gambling machine is, however, associated with the disadvantage that the game-result determining system depends on a periodic signal generation based on the oscillator with a coupled frequency control provided in this case. Periodically generated signals are associated with the danger, even when the frequency is correspondingly changed, that nevertheless the periodicity can allow that errors occur in the random number. A further danger is to be seen in that undesired feedback couplings can lead to problems and deficiencies. Even though the oscillator can be considered as a random number generator, nevertheless the recited dangers can lead to errors or limitations, which limit the selection of the random number in such a way that no pure random selection is achieved. It has been found, for example, that clever players can succeed with these systems to detect the associated weaknesses and to exploit them.

SUMMARY OF THE INVENTION

1. Purpose of the Invention

It is an object of the present invention to improve a gambling machine, wherein the hits of the winning symbol combinations based on the pseudo-random number generator are not predictable and cannot be influenced, and wherein a stopping of the plurality of rotating reel bodies is made possible according to a substantially uniform sequence.

These and other objects and advantages of the present invention will become evident from the description which follows.

2. Brief Description of the Invention

The invention method is associated with the advantage that, based on the use of a table, it is assured on the one hand that all winning classes are processed and that, based on a scrambling of the winning classes within the table, on the other hand, it cannot be predicted, when which winning class is drawn. Based on the use of winning classes, it is assured that the winning classes come to be drawn according to a predetermined frequency. Furthermore, the method allows to stop the rotating reel bodies within an approximately uniform time interval.

The present invention provides for a method for determining stop positions of displayed rotating reels comprising the following steps. A game is initiated. A pseudo-random number is determined with a pseudo-random number generating means. The pseudo-random number is compared with numbers in subsets of a set of numbers generatable by the pseudo-random number generating means. The subset associated with the pseudo-random number and the win class associated with the subset is determined. A symbol combination associated with the win class is determined. Then it is determined if the symbol combination is displayable based on conditions imposed relating to a starting position of the displayed rotating reels and relating to the time period of rotation permissible for the displayed rotating reels. A symbol combination which is not displayable is rejected. The above steps are repeated by and upon determining a next following pseudo-random number with the pseudo-random number generating means.

The displayed rotating reels can be provided by rotating reel bodies forming part of a gambling machine. The game process of the gambling machine can be controlled with a control unit including a microcomputer. The rotating reel bodies can be put to a stop at predetermined positions with the control unit. The positions of the rotating reel bodies can be observed with position-recognizing sensors connected to the control unit. Position signals can be delivered from the position-recognizing sensors to the control unit. Win situations are classified into win classes.

The delivered position signals from the position-recognizing sensor can be compared to values of counted positions stored in a memory of the microcomputer. A discrepancy can be observed between the value of the delivered position signal and of the value of the counted position. The following rotation of the rotating reel bodies can be corrected based on any discrepancy.

A start can take place from a precedingly displayed symbol combination for determining displayability of a symbol combination associated with a win class. It can be determined if the symbol combination is displayable based on the precedingly displayed symbol combination and a permissible range of total symbol steps for a respective displayed rotating reel.

A start-up procedure can be performed prior to an actual determination and can include the following steps. A pseudo-random number is determined with a pseudo-random number generating means. The pseudo-random number is compared with numbers in subsets of a set of numbers generatable by the pseudo-random number generating means. The subset associated with the pseudo-random number and the win class associated with the subset is determined. A symbol combination associated with the win class is determined. Then it is determined if the symbol combination is displayable based on conditions imposed relating to a starting position of the displayed rotating reels and relating to the time period of rotation permissible for the rotating reels. A symbol combination which is not displayable is rejected. The above steps are repeated by and upon determining a next following pseudo-random number with the pseudo-random number generating means. The win class associated with the pseudo-random number can be entered to a top of a memory stack. The steps of determining a pseudo-random number and entering the win class can be repeated a predetermined number of times.

The win class associated with the pseudo-random number determined can be entered to the top of the memory stack. A win class can be removed from the bottom of the memory stack. The win class removed from the bottom of the memory stack can be employed in determining a symbol combination associated with the win class.

The win class associated with a non-displayable symbol combination can be written to the top of the memory stack. A next win class can be read and removed from the bottom of the stack after the writing of the win class associated with the non-displayable symbol combination. The next win class removed from the bottom of the memory stack can be employed in determining a symbol combination associated with the win class.

Preferably, at least a full rotation is performed with each displayed rotating reel.

A plurality of symbol combinations to be displayed associated with a win class can be encountered. For each one of the plurality of symbol combinations it can be determined if this symbol combination is displayable. It can be determined if there is one or a plurality of displayable symbol combinations. In case of a plurality of displayable symbol combinations, a pseudo-random number can be generated for selecting which one of the displayable symbol combinations is to be displayed.

A displayable symbol combination can be encountered. It can be determined if there is a plurality of symbol combinations displayable. In case of a plurality of symbol combinations displayable, a pseudo-random number can be generated for selecting which one of the plurality of displayable symbol combinations is to be displayed.

The number of steps of the respective step motors can be determined for advancing a rotor of the respective step motor. The step motors can be activated in accordance with the number of steps determined. The rotation of the rotor of the step motors can be transferred to the respective displayed rotating reels.

A method for determining the stop positions of displayed rotating reels includes the following steps. A game is initiated. A pseudo-random number is determined with a pseudo-random number generating means. The pseudo-random number is compared with numbers in subsets of a set of numbers generatable by the pseudo-random number generating means. The subset associated with the pseudo-random number and the win class associated with the subset is being determined. A plurality of symbol combinations associated with the win class are being determined. A second pseudo-random number is being determined with the pseudo-random number generating means. The pseudo-random number is associated with one of the plurality of symbol combinations. The symbol combination associated with the pseudo-random number is being displayed.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention:

FIG. 5 shows a table illustrating win classes, number regions, and associated symbol combinations.

DESCRIPTION OF THE INVENTION AND PREFERRED EMBODIMENT

Figure 1:
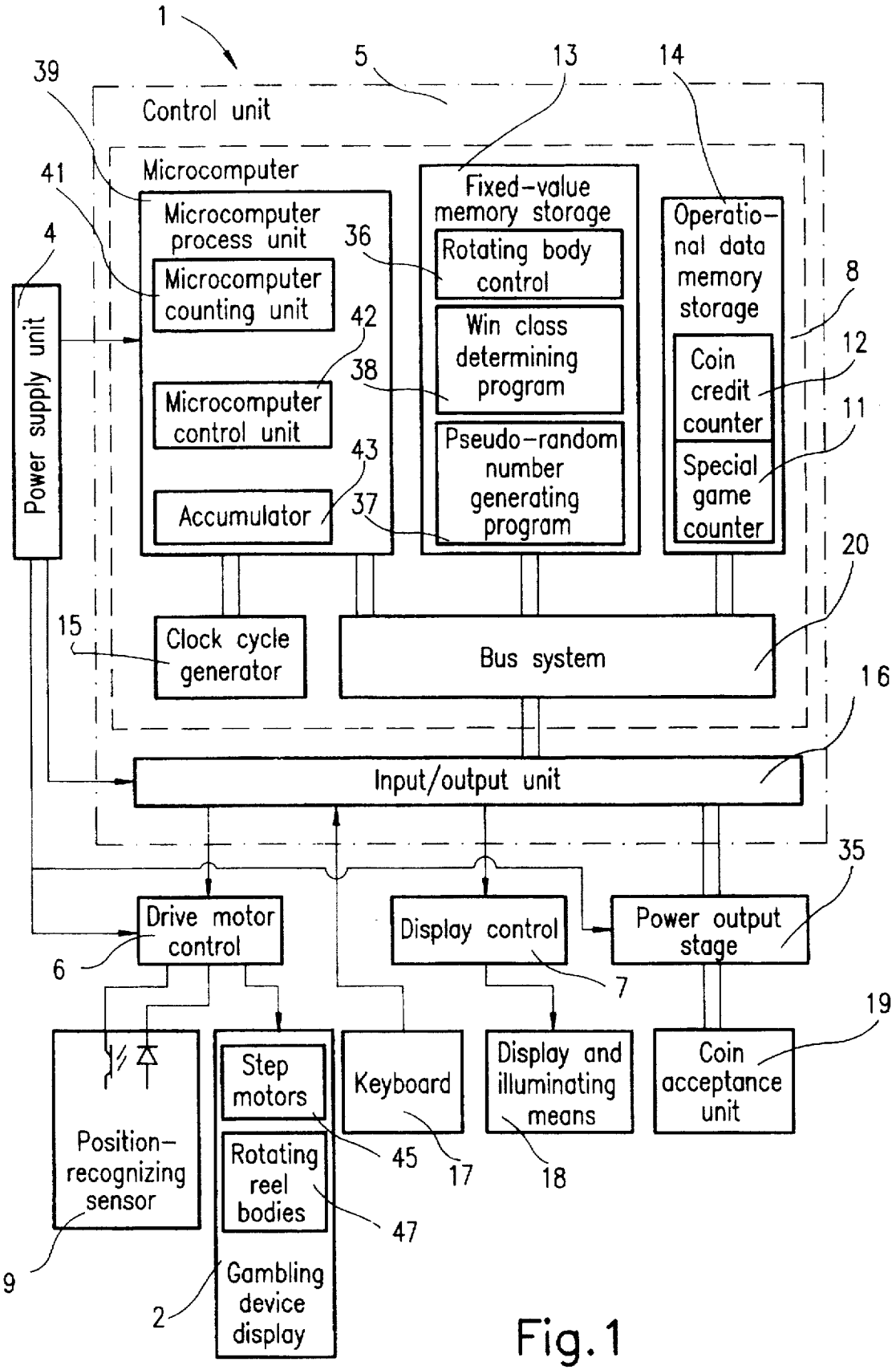
FIG. 1 shows a schematic block circuit of an apparatus for determining pseudo-random numbers and for displaying the game results at a coin-operated gambling machine.

The present invention provides for a method for determining stop positions of displayed rotating reels of a game device or a gambling machine. The gambling machine includes a control unit 5 with a microcomputer 8 for controlling the game process. The control unit 5 puts the displayed rotating reels, provided as rotating reel bodies 47, to a stop in predetermined positions. The positions are determined based on a pseudo-random control system. The positions of the displayed rotating reels are observed with position-recognizing sensors 9 connected to the control unit 5 and disposed on the side of the displayed rotating reel. The obtainable winning situations are classified into win classes. A disjoint subset of a set of numbers is coordinated to each win class. A pseudo-random number generator 37 determines a pseudo-random number within the set, whereby the win class is determined based on the subset containing the pseudo-random number. A symbol combination associated with the win class is displayed on the displayed rotating reels.

Preferably, the symbol combination to be displayed is to be provided starting from a precedingly displayed symbol combination within a given total number of steps between two predetermined values representing a band width. In case of non-displayability of the symbol combination between the two predetermined values representing a band width of the total step numbers, the symbol combination can be rejected and a new win class can be determined based on a different pseudo-random number.

Upon startup procedure of the gambling machine, win classes can be determined with pseudo-random numbers generated by the pseudo-random number generator 37 and the win classes can be registered in a memory storage of the control unit 5. The symbol combination or symbol combinations, coordinated to the win classes, are displayed sequentially. The win class, after the display of the symbol combination, coordinated to this win class can be erased from the memory storage. After the completed display of a symbol combination coordinated to a win class, a new win class can be determined by a pseudo-random number generated with the pseudo-random number generator 37 and can be entered in the memory storage.

Starting from the symbol combination shown in the stop position of the rotating reel bodies, the subsequently to be displayed symbol combinations can be displayed at least after one full rotation of the displayed rotating reel and then subsequently within a predetermined number of successive symbol positions.

The pseudo-random number generator can determine, in case of a win class which is associated with a plurality of symbol combinations, which one of the displayable symbol combinations of the respective win class is to be displayed.

The block circuit diagram illustrated in FIG. 1 and designated with reference numeral 1 represents elements and their mutual connections necessary to realize an embodiment of the present invention of a coin-operated gambling machine with win possibility. The block circuit diagram 1 comprises a gambling device display 2, a power supply unit 4, 204, a control unit 5, 205 with a microcomputer 8, 208 and a drive motor control 6, a display control 7, 207 as well as a power output stage for the display elements or display and illuminating means. The control unit 5, 205, the drive motor control 6, and the power output stage 35, 235 have an input connected to an output of the power supply unit 4, 204. The gambling device display 2 has an input connected to an output of the drive motor control 6. The control unit 5 includes a microcomputer 8 and an input/output unit 16. The display control 7 has an input connected to an output of the input/output unit 16.

The gambling device display 2 comprises disk-shaped or reel-shaped rotating reel bodies 47 which are driven by step motors 45. Symbols to be displayed are present on displayed rotating reels such as provided by the rotating reel bodies 47. Each rotating reel body 47 is associated with a position-recognizing sensor 9 connected to the drive motor control 6. The step motors 45 and the position-recognizing sensors 9 are connected by means of the drive motor control 6 to the control unit 5, where the control unit 5 includes the microcomputer 8. The microcomputer 8 includes a microcomputer process unit 39, 239 with a microcomputer counting unit 41, 241, a microcomputer control unit 42, 242, and an accumulator 43, 243.

The microcomputer 8 of the control unit 5 further comprises a fixed-value memory storage 13 or a read-only memory ROM with a rotating reel body control 36, with a pseudo-random-number generating program means 37, and with a win class determining program means 38, 238, as well as an operational data memory storage 14, 214 or random access memory, where the coin, currency, or token credits and special games or extra plays are recorded, as well as the other device components necessary for the operation of such a unit such as a buffer, a clock cycle generator 15, 215 connected to the microcomputer process unit 39, 239, a bus system 20 connected to the microcomputer process unit 39, 239, the fixed-value memory storage 13 and the operational data memory storage 14, 214, and the like. An input/output unit 16, 216 connected to the bus system 20, 220 forms the interface between the microcomputer 8, 208 and the peripherals 6, 7, 207, 17, 217, 35, 235 connected to the input/output unit 16, 216. The peripherals comprise operating elements 17, 217 formed as keys or buttons, display and illuminating means 18, 218 for presenting a status of the coin, currency or token credit counter 12, 212 and for presenting the contents of the special game and extra play counter 11, 211 of the microcomputer 8, 208 as well as a coin acceptance unit 19, 219 connected to the power output stage 35, 235. The coin acceptance unit 19, 219 includes a coin validator and a payout unit. These peripheral devices are disposed at the front side of the gambling machine.

The power supply unit 4, 204 provides the voltage supply of the complete gambling machine. The required voltages are derived at a grid power transformer contained in the power supply unit 4, 204. The voltages delivered by the grid power transformer are rectified and delivered to the various device groups.

Figure 2:
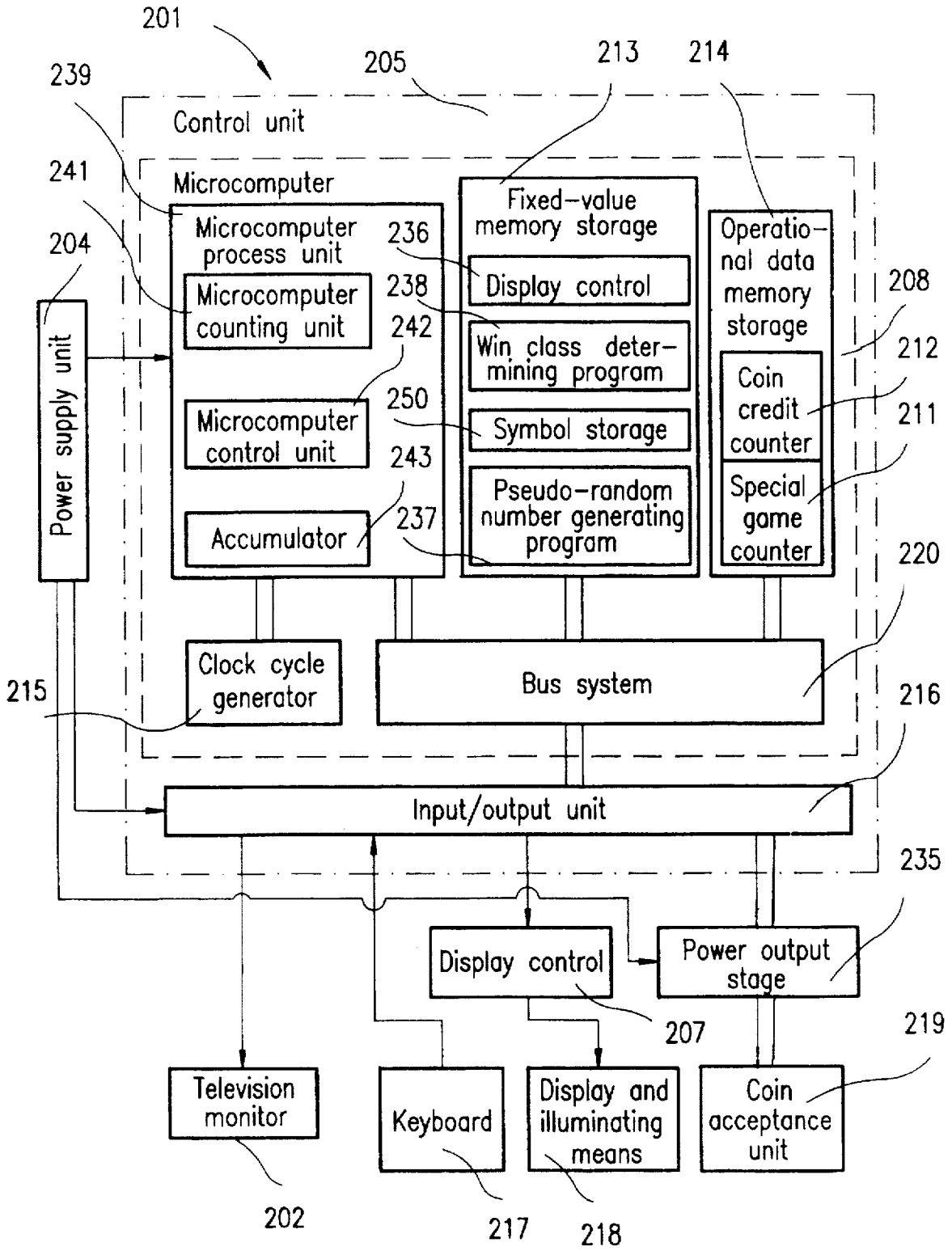
FIG. 2 shows a schematic block circuit diagram of an alternate apparatus.

The block circuit diagram illustrated in FIG. 2 and designated with reference numeral 201 shows an alternate circuit diagram, where the recognizing device and the game device are replaced by a television monitor 202, by a personal computer monitor, or by a video terminal. In this case, the position-recognizing sensor 9, the drive motor control 6, and the gambling device display 2 with rotating reel bodies are eliminated relative to the embodiment of FIG. 1. Instead, for example, a television monitor 202 is connected to the input/output unit 216 and controlled by the microcomputer 208. In addition, the control of the rotating reel body present in the fixed-value memory storage 13 of FIG. 1 is replaced by a win display control 236 and, in addition, a symbol storage 250 is included in the fixed value-memory storage 213, e.g. represented by a read only memory ROM. The symbol storage 250 contains the symbols to be presented on the television monitor 202. The use of a television monitor 202 excludes possibilities of manipulation present in the case of rotating reel bodies, e.g. of a mechanical nature, and, consequently, a checking of the game stop positions of the rotating reel bodies by a position recognizing device is no longer required.

In case the invention method is performed in connection with the apparatus embodiment of FIG. 2, then the microcomputer 208 of the control unit 205 determines with the pseudo-random number generating program means 237 a pseudo-random number for the symbol of a first possible game stop position. If the result is not equal to zero and the pseudo-random number does not coincide with a predetermined number in the result output region, then an additional or new pseudo-random number is generated for the symbol of the next following possible stop position. On the other hand, if the pseudo-random number is equal to the predetermined number in the result output region, then the symbol considered for being drawn is read out of the symbol storage 250 through the bus system 220 and delivered through the input/output unit 216 to the display television monitor 202.

According to a preferred embodiment, the predetermined number to be compared with the pseudo-random number is selected to be zero for each result output region. The adaptation of pseudo-random numbers generated by the pseudo-random number generating means 237 can be performed by a modulo division of the pseudo-random number through the number of elements of the result output region, wherein the modulo residue represents the pseudo-random number to be compared with the predetermined number.

Figure 3:
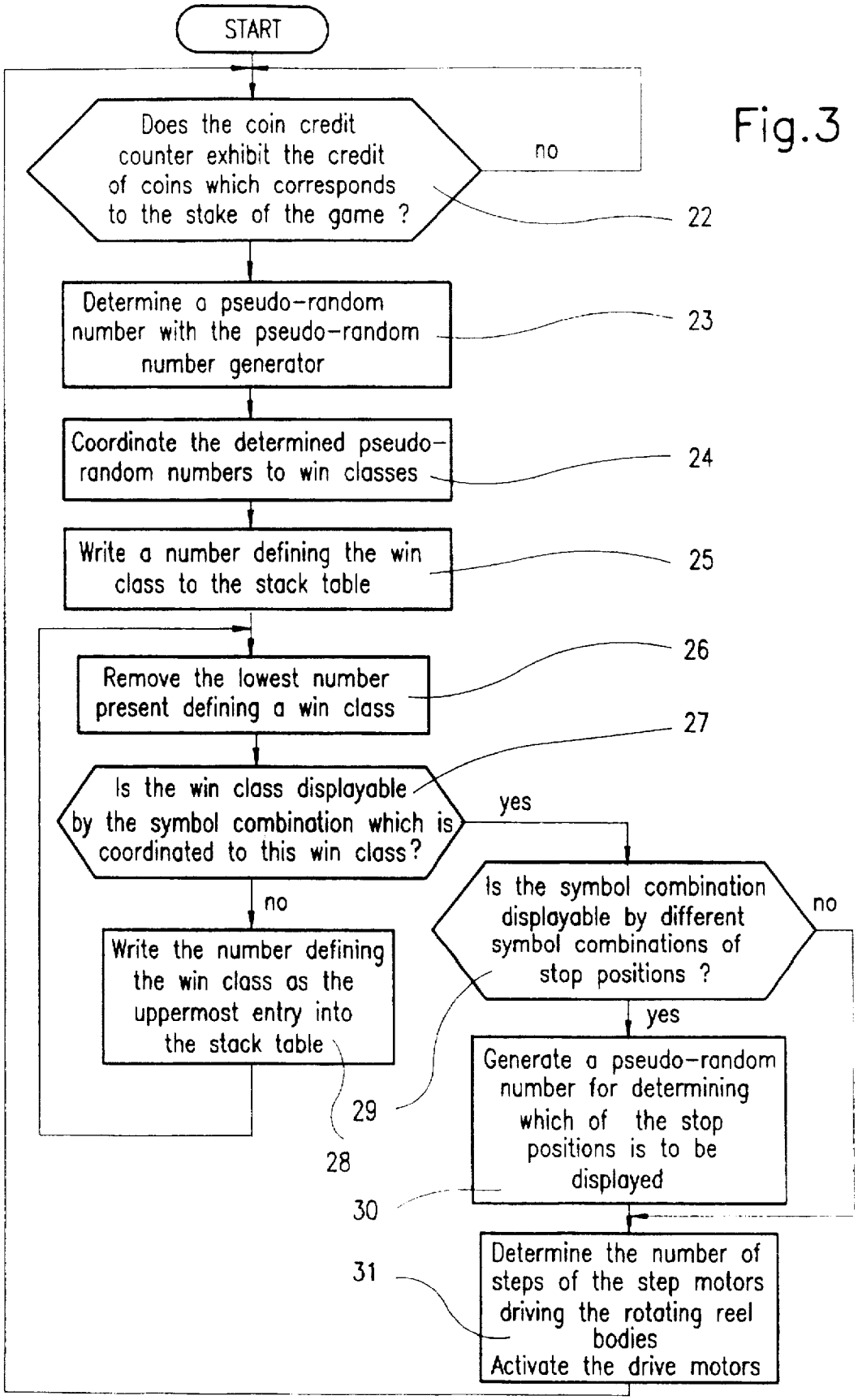
FIG. 3 shows a flow diagram for determining the symbols displayed.

The determination of pseudo-random numbers and the therefrom derived stop positions of the rotating reel bodies are performed according to the flow diagram illustrated in FIG. 3. The control unit 5 continuously checks whether coins are fed to the gambling machine or, respectively, whether the coin, currency or token credit counter 12, 212 exhibits a credit which corresponds to the stake of the game (branch block 22). When the coin, currency or token credit counter 12, 212 indicated at least a stake of the game, then a pseudo-random number between 1 and 100,000 is determined with a pseudo-random number generator (operational block 23). The pseudo-random number is associated with a win class. Symbol combinations corresponding to a lost game in class 0 are coordinated to the pseudo-random numbers 1 to 84,279. The winning class 1 is associated with the pseudo-random numbers 84,280 to 92,554. The winning class 2 is associated with the pseudo-random numbers 92,555 to 97,834. The pseudo-random numbers 97,835 to 99,074, determined by the pseudo-random number generating program means, are associated with the winning class 3. Pseudo-random numbers 99,075 to 99,494 are associated with winning class 4, etc. The pseudo-random numbers 99,996 to 100,000 (operational block 24) are associated with the highest winning class 9. The association between the win classes and the respective number regions of the embodiment are illustrated in FIG. 5.

According to the winning plan of the respective gambling machine, different symbol combinations can be coordinated to a winning class. For example, if there are three display drums, formed by rotating reel bodies, and if a cherry is shown in the view window on each stopped rotating reel body, or two times a cherry and one time a BAR are shown in the view windows, then each one of these symbol combinations is associated with the same winning value, i.e. for example $2.00.

After the transformation of the pseudo-random numbers, determined by the pseudo-random number generating program means, into the win classes, a pointer given by a number defining the respective win class is stored in a memory stack or stack table in the operational data memory storage 14, 214 of the microcomputer 8 (operational block 25), where the stack table exhibits a memory structure of a first-in, first-out memory storage, and wherein the pointers of numbers defining respective win classes are read exactly in the same sequence (operational block 26) in which they were entered.

The purpose of determining an advance quantity of say 100 is to avoid a problem based on the possibility that there may be win classes which are not representable based on the starting position of the rotating reel bodies or of the display means and on the permissible rotation ranges.

After the first initialization of the control unit 5, for example an advance quantity of 100 pseudo-random numbers are determined by the pseudo-random number generating program means, and each pseudo-random number is coordinated to an associated one of the win classes available. The win classes are registered in the operational data memory storage 14, 214 in the sequence drawn directly or via pointers. A pointer to the win class is then stored in the memory stack or stack table. This procedure determines in advance the game results of the next 100 games. The number 100 is an arbitrary number and a smaller or larger number can be similarly selected. The advance quantity is independent of the number of win classes, which is 9 in the present embodiment. In the following, the rotating reel bodies are stopped in a predetermined initial position. After the reading and removal of the lowest existing pointer to a win class from the stack table, it is subsequently tested and checked if the symbol combination, coordinated to the pointer of the win class in case of a successive stopping of the rotating reel bodies, e.g., the first reel after 1 second, the second reel after 1.5 seconds, and the third reel after 2 seconds, can be displayed.

For example, each rotating reel body can be furnished with 20 symbols. The first reel body is to stop after about 1 second. This means that a minimum of 29 and a maximum of 33 symbols pass through the view window within one second. Thus, the reel body is to be stopped at one position of the predetermined total rotation angle range of variation of, in the present case, 5 symbols. If the win class to be represented requires it, then the first reel body can be stopped directly after 29 symbols to after a maximum of 33 symbols. The total rotation angle range of variation of, in the present example, 5 symbols can be varied and can be enlarged or decreased. If the total rotation angle range of variation is increased, then the probability is increased that the win classes can be represented sequentially such as they were determined with the pseudo-random number generator generating the pseudo-random numbers in the present assignment of win classes.

The second reel body is to be stopped after approximately 1.5 seconds after starting. This means that at least 45 symbols pass through the view window and at most 49 symbols. The third reel body is stopped after about 2 seconds, which means that at least 61 symbols and at most 65 symbols pass by the view window before the reel body comes to rest and thus the symbol combination of the respective win class is displayed.

The microcomputer 8 tests if starting from the symbol combination displayed at an initial time the symbol combination to be displayed by the stopped rotating reel body is reachable within a predetermined band width corresponding to a time period and to a corresponding number of associated steps (branch block 27). The number of steps to be permissible is set such that the rotating reel body has to perform at least one full rotation and that within a predetermined number of subsequent symbol positions or symbol steps, for example nine, the desired stop position should be reached. If the win class to be shown cannot be displayed within the band width of the predetermined number of steps, then the winning class is written back into the stack table as the uppermost entry (operational block 28) and the next following pointer to a win class is drawn from the bottom of the stack table and checked in the previously known way (branching block 27), if the symbol combination, coordinated to the winning class can be represented. This procedure assures that a further randomization of the win classes represented in the stack table occurs. This insures again that a further aspect of unpredictability occurs in connection with the determination of the algorithm providing the pseudo-random numbers and associating the respective win classes and providing a further step of chance relating to the result of the next game. If the win class should be representable by different symbol combinations or in different step widths (operational block 29), then these stop positions are intermediately stored in the memory storage and, in the following, a pseudo-random number given by the pseudo-random number generator (operational block 30) determines which one of the stop positions is to be displayed. The desired stop positions are transferred to the drive motor control (operational block 31). The drive motor control delivers power to the drive motors, furnished as step motors, in such a way that the rotating reel bodies, driven by the drive motors, are stopped in the predetermined stop position.

The reel bodies can be driven by gear belts, by a gear system, directly by a disk system, or they can be provided by turned cards. The step motors can be operated by a control of full steps, half-steps, and microsteps. The step motors can be connected for unipolar or bipolar operation. In unipolar operation, the field coils have a center terminal and the respective end terminals of the coils are connected and disconnected. In bipolar operation, the flow direction of the direct current through the coils is reversed to induce the rotation of the rotor. The current flow direction can be switched, e.g. by four field effect transistors or high current automatic switch controllers L298. The drive motor control 6 assures that the motor and the reel body rotate in a forward direction.

Position-recognizing sensors, coordinated to and associated with the rotating reel bodies, allow to determine for each rotation of a rotating reel body if the symbol, momentarily passing-through the display window, coincides with the symbol of the drive control. The position-recognizing sensors can be provided by a light barrier system scanning bright and dark fields of a perforated rotating disk and delivering control signals to the processor system. The processor determines based on the control signals if the game runs to its end without error.

The microcomputer 8 internally counts how many control pulses the microcomputer 8 has delivered to the drive motor control 6. In addition, the synchronization signal is fed to the microcomputer from the position-recognizing sensor 9 through the drive motor control 6 and the input/output unit 16. One pulse is generated by the position-recognizing sensor 9 for each full rotation of the reel-shaped rotating body. The point in time of the pulse is compared with the internal counter state of the microcomputer by the microcomputer. In case the microcomputer determines a deviation between the set value according to the internal counter and the actual value according to the pulse from the position-recognizing sensor 9, then this difference is balanced out by the microcomputer 8 during the next following rotation of the reel body. Based on the difference value recognized by the microcomputer, a larger or smaller number of step pulses are delivered to the step drive motor by the drive motor control 6 as commanded by the microcomputer 8.

In case of a deviation between the actually momentarily passing-through symbol and the symbol set by the microcomputer for the drive control, the difference value is determined in the microcomputer and corrected signals for the next following rotation are delivered to the drive motor control and the corrected step number is delivered by the drive control unit to the respective step motor or step motors.

Figure 4:
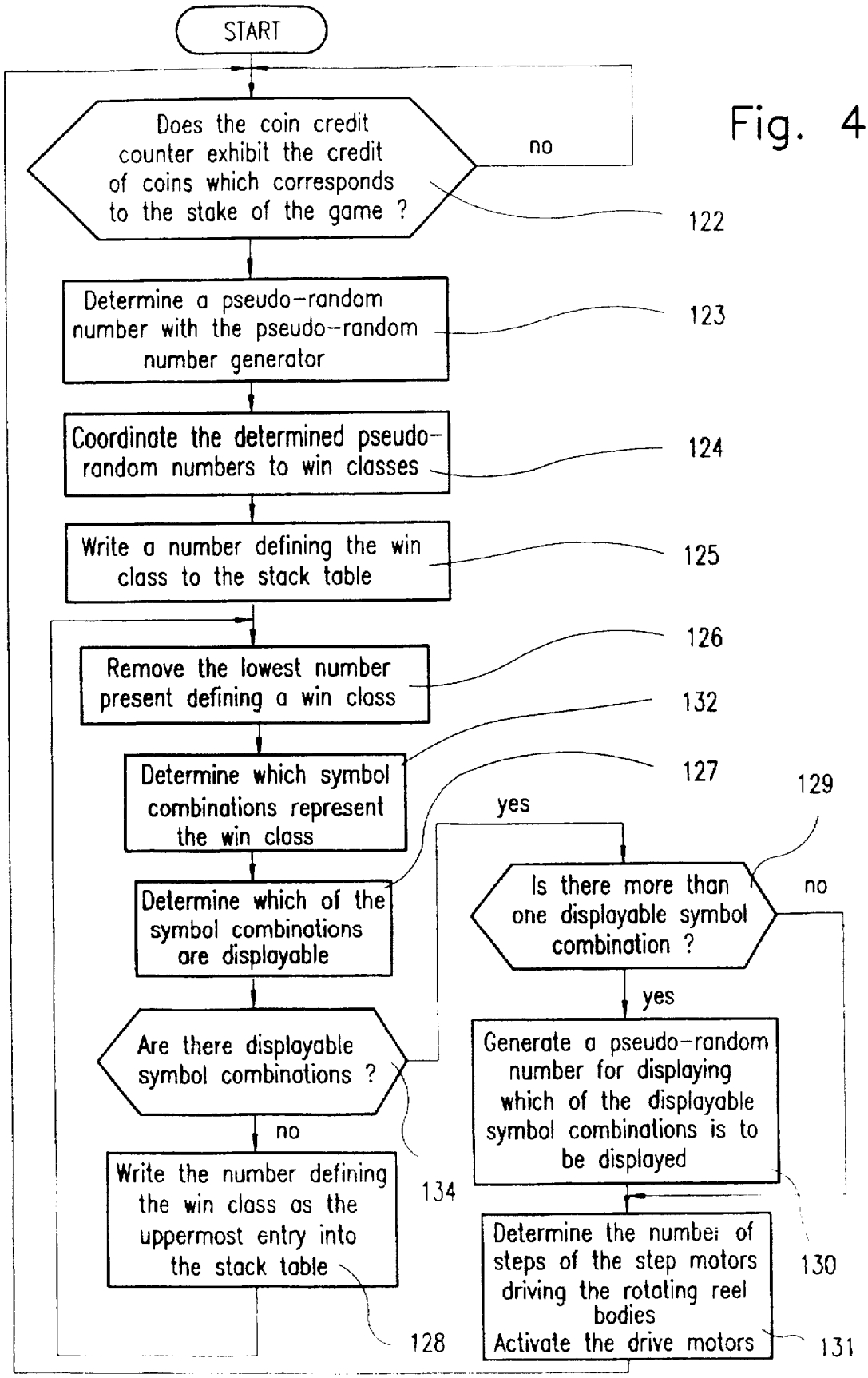
FIG. 4 shows a flow diagram for determining the symbols displayed according to a second embodiment.

According to the embodiment of FIG. 4, modified relative to the embodiment of FIG. 3, the step 122 determines if a credit of coins, currency or tokens exists to initiate a game. As a first step 123 of a game, a pseudo-random number is determined with a pseudo-random number generating program means 37. The determined pseudo-random number is associated with a win class in step 124. A pointer representing the win class is written to the top of a stack table in step 125. A pointer at the bottom of the stack table is read and removed from the stack table in step 126. The next step 132 determines which symbol combinations to be displayed represent the win class. Then, a determination is made which of the symbol combinations to be displayed can be actually represented and are accessible by a rotation of the rotating reel bodies in step 127 taking into consideration that the permissible time period, after which each rotating reel body can be stopped, has to be within a narrow range to create the impression to the player that the rotating reel bodies in each game stop after a substantially equal time period independent of the game which is played. If there are no representable symbol combinations in the win class as determined in step 134, then the pointer defining the win class is written to the top of the stack table to be available again for a later game in step 128. If there are representable symbol combinations, a determination is made if there is one such symbol combination or a plurality in step 129. If a plurality is present, then a pseudo-random number is generated in step 130 to determine which one of the plurality of symbol combinations is to be displayed. Based on the selection of the symbol combination, the number of steps to be activated for each step motor is determined in step 131 and the step motors turn to display the symbol combination obtained.

FIG. 5 shows a table with the number regions associated to the various win classes. Each win class is associated with one or more symbol combinations represented in the table by Roman capital letters and to be displayed.

It will be understood that each of the elements described above, or two or more together, may also find a useful application in other types of methods for the determination of stop positions of rotating reel bodies differing from the types described above.

While the invention has been illustrated and described as embodied in the context of a method for the determination of stop positions of rotating reel bodies of a game device of a gambling machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for determining stop positions of displayed rotating reels comprising the steps initiating a game;

determining a pseudo-random number with a pseudo-random number generating means;

comparing the pseudo-random number with numbers in subsets of a set of numbers generatable by the pseudo-random number generating means;

determining the subset associated with the pseudo-random number and a win class associated with the subset;

determining a symbol combination associated with the win class;

determining in the control unit if the symbol combination is displayable based on conditions imposed relating to a starting position of the displayed rotating reels and relating to the time period of rotation permissible for the displayed rotating reels;

rejecting a symbol combination which is not displayable, and repeating the above steps by and upon determining a next following pseudo-random number with the pseudo-random number generating means.

2. The method according to claim 1, wherein the displayed rotating reels are provided by rotating reel bodies forming part of a gambling machine, further comprising controlling the game process of the gambling machine with a control unit including a microcomputer;

putting the rotating reel bodies to a stop at predetermined positions with the control unit;

observing the positions of the rotating reel bodies with position-recognizing sensors connected to the control unit;

delivering position signals from the position-recognizing sensors to the control unit;

classifying win situations into win classes.

3. The method according to claim 2, further comprising comparing the delivered position signals from the position-recognizing sensor to values of counted positions stored in a memory of the microcomputer;

observing a discrepancy between the value of the delivered position signal and of the value of the counted position;

correcting the following rotation of the rotating reel bodies based on any discrepancy.

4. The method according to claim 1, further comprising starting from a precedingly displayed symbol combination for determining displayability of a symbol combination associated with a win class;

determining if the symbol combination is displayable based on the precedingly displayed symbol combination and a permissible range of total symbol steps for a respective displayed rotating reel.

5. The method according to claim 1, further comprising performing a start-up procedure prior to an actual determination including the steps of determining a pseudo-random number with a pseudo-random number generating means;

comparing the pseudo-random number with numbers in subsets of a set of numbers generatable by the pseudo-random number generating means;

determining the subset associated with the pseudo-random number and the win class associated with the subset;

determining a symbol combination associated with the win class;

determining if the symbol combination is displayable based on conditions imposed relating to a starting position of the displayed rotating reels and relating to the time period of rotation permissible for the rotating reels;

rejecting a symbol combination which is not displayable, and repeating the above steps by and upon determining a next following pseudo-random number with the pseudo-random number generating means;

entering the win class associated with the pseudo-random number to a top of a memory stack;

repeating the steps of determining a pseudo-random number and entering the win class a predetermined number of times.

6. The method according to claim 5, further comprising entering the win class associated with the pseudo-random number determined to the top of the memory stack;

removing a win class from the bottom of the memory stack; employing the win class removed from the bottom of the memory stack in determining a symbol combination associated with the win class.

7. The method according to claim 6, further comprising writing the win class associated with a non-displayable symbol combination to the top of the memory stack;

reading and removing a next win class from the bottom of the stack after the writing of the win class associated with the non-displayable symbol combination;

employing the next win class removed from the bottom of the memory stack in determining a symbol combination associated with the win class.

8. The method according to claim 1, further comprising performing at least a full rotation with each displayed rotating reel.

9. The method according to claim 1, further comprising encountering a plurality of symbol combinations to be displayed associated with a win class;

determining for each one of the plurality of symbol combinations if this symbol combination is displayable;

determining if there is one or a plurality of displayable symbol combinations;

generating in case of a plurality of displayable symbol combinations a pseudo-random number for selecting which one of the displayable symbol combinations is to be displayed.

10. The method according to claim 1, further comprising encountering a displayable symbol combination;

determining if there is a plurality of symbol combinations displayable;

displayable a pseudo-random number for selecting which one of the plurality of displayable symbol combinations is to be displayed.

11. The method according to claim 1, further comprising determining the number of steps of the respective step motors for advancing a rotor of the respective step motor;

activating the step motors in accordance with the number of steps determined;

transferring the rotation of the rotor of the step motors to the respective displayed rotating reel.

12. A method for determining stop positions of displayed rotating reels of a game device or gambling machine comprising the steps of:

providing a gambling machine having a plurality of rotating reels, each reel having a plurality of symbols;

providing the gambling machine with a control unit with a microcomputer for controlling the game process;

determining positions of the rotating reels based on a pseudo-random control system;

initiating a rotation of the rotating reels;

observing the positions of the displayed rotating reels with position-recognizing sensors connected to the control unit and disposed on the side of the displayed rotating reel;

stopping the displayed rotating reels with the control unit in predetermined positions;

classifying obtainable winning situations into win classes;

coordinating a disjoint subset of a set of numbers to each win class;

determining a pseudo-random number within the set with a pseudo-random number generator, whereby the win class is determined based on the subset containing the pseudo-random number;

displaying a symbol combination associated with the win class on the displayed rotating reels;

providing the symbol combination to be displayed starting from a precedingly to be displayed symbol combination within a given total number of steps between two predetermined values representing a band width;

rejecting the symbol combination in case of non-displayability of the symbol combination between the two predetermined values representing a band width of the total step numbers; and determining a new win class based on a different pseudo-random number.

13. The method according to claim 12, wherein, upon startup procedure of the gambling machine, win classes are determined with pseudo-random numbers generated by the pseudo-random number generator and the win classes are registered in a memory storage of the control unit, and wherein the symbol combination or symbol combinations, coordinated to the win classes, are displayed sequentially, and wherein the win class, after the display of the symbol combination, coordinated to this win class, is erased from the memory storage, and wherein after the completed display of a symbol combination coordinated to a win class, a new win class is determined by a pseudo-random number generated with the pseudo-random number generator and is entered in the memory storage.

14. The method according to claim 12, wherein, starting from the symbol combination shown in the stop position of the rotating reel bodies, the subsequently to be displayed symbol combinations are displayable at least after one full rotation of the displayed rotating reel and then subsequently within a predetermined number of successive symbol positions.

15. The method according to claim 12, wherein the pseudo-random number generator determines, in case of a win class which is associated with a plurality of symbol combinations, which one of the displayable symbol combinations of the respective win class is to be displayed.

16. A method for determining the stop positions of displayed rotating reel bodies, comprising the steps initiating a game;

determining a pseudo-random number with a pseudo-random number generating means;

comparing the pseudo-random number with numbers in subsets of a set of numbers generatable by the pseudo-random number generating means in a comparison means;

determining the subset associated with the pseudo-random number and a win class associated with the subset;

determining a plurality of symbol combinations associated with the win class in a control unit;

determining a second pseudo-random number with the pseudo-random number generating means;

associating the pseudo-random number with one of the plurality of symbol combinations;

displaying the symbol combination associated with the pseudo-random number.

* * * * *